US008773479B2

(12) United States Patent
Nishimori et al.

(10) Patent No.: US 8,773,479 B2
(45) Date of Patent: Jul. 8, 2014

(54) ELECTRO-OPTIC DEVICE, ELECTRONIC APPARATUS, AND METHOD FOR DRIVING ELECTRO-OPTIC DEVICE

(75) Inventors: Takashi Nishimori, Suwa (JP); Tetsuro Yamazaki, Shiojiri (JP); Takashi Toyooka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 13/595,144

(22) Filed: Aug. 27, 2012

(65) Prior Publication Data

US 2013/0069993 A1 Mar. 21, 2013

(30) Foreign Application Priority Data

Sep. 15, 2011 (JP) ..... 2011-202250

(51) Int. Cl.
*G09G 3/36* (2006.01)

(52) U.S. Cl.
USPC ..... 345/691; 345/690; 345/89

(58) Field of Classification Search
USPC ..... 345/63, 89, 204, 690–691; 348/759, 348/750, 771; 359/247, 246
See application file for complete search history.

(56) References Cited

U.S. PATENT DOCUMENTS

| | | | | |
|---|---|---|---|---|
| 6,057,809 | A * | 5/2000 | Singhal et al. | 345/3.3 |
| 7,956,857 | B2 * | 6/2011 | Willis | 345/204 |
| 8,531,369 | B2 * | 9/2013 | Toyooka | 345/89 |
| 2002/0158857 | A1 | 10/2002 | Iisaka | |

FOREIGN PATENT DOCUMENTS

| | | |
|---|---|---|
| JP | A-9-138384 | 5/1997 |
| JP | A-2003-114661 | 4/2003 |

* cited by examiner

*Primary Examiner* — Andrew Sasinowski
(74) *Attorney, Agent, or Firm* — Oliff PLC

(57) ABSTRACT

An electro-optic device has electro-optic elements; a storage units storing a first table including pairs of a gray-scale value and an a-bit sub-field code and a second table including pairs of a gray-scale value and a b-bit (b>a) sub-field code; a converting unit converting the gray-scale value of an object pixel into the sub-field code using the second table when a difference in gray-scale value between a first image and a second image is less than a threshold value, while converting the gray-scale value of the object pixel into the sub-field code using the first table when the difference in gray-scale value between the first image and the second image is the threshold value or more; and a driving unit supplying a signal corresponding to the sub-field code converted by the converting unit to drive the electro-optic elements.

11 Claims, 9 Drawing Sheets

FIG. 8
211
| GRAY-SCALE VALUE | SF CODE |
|---|---|
| 0 | 0000000000 |
| 1 | 0000000001 |
| 2 | 0000000011 |
| 3 | 0000000111 |
| ... | ... |
212
| GRAY-SCALE VALUE | SF CODE |
|---|---|
| 0 | 00000000000000000000 |
| 1 | 00000000000000000001 |
| 2 | 00000000000000000011 |
| 3 | 00000000000000000111 |
| ... | ... |
FIG. 9A WHEN GRAY-SCALE VALUES ARE DIFFERENT
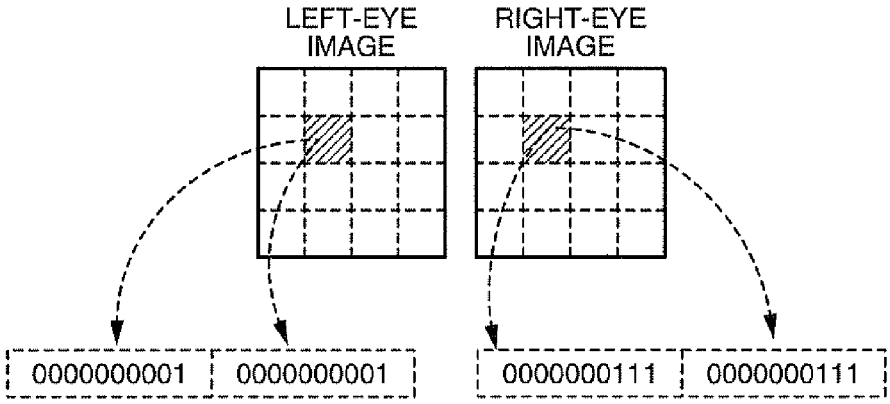
FIG. 9B WHEN GRAY-SCALE VALUES ARE THE SAME
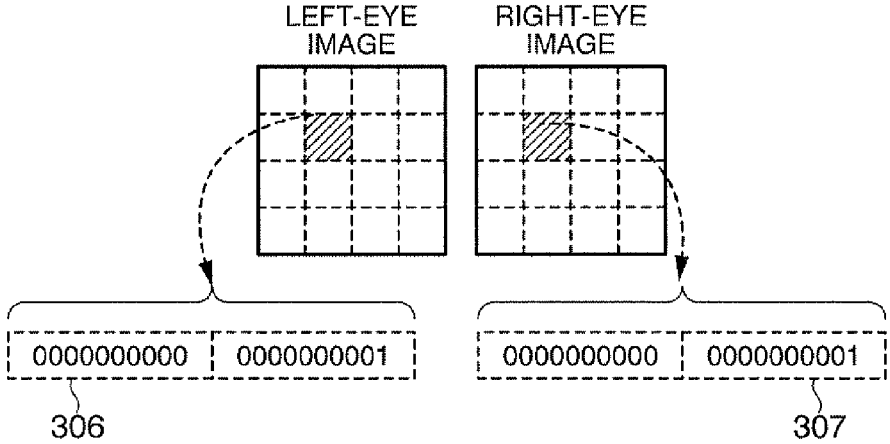

ELECTRO-OPTIC DEVICE, ELECTRONIC APPARATUS, AND METHOD FOR DRIVING ELECTRO-OPTIC DEVICE

BACKGROUND

1. Technical Field

The present invention relates to a technique for performing gray-scale display control by a sub-field driving method.

2. Related Art

As gray-scale controlling methods in liquid crystal elements, a so-called sub-field driving method in which a time for applying a constant voltage to a liquid crystal element is modulated, in addition to a voltage modulation method in which a voltage to be applied to a liquid crystal element is modulated, has been known (JP-A-2003-114661). In the sub-field driving method, one frame is divided into a plurality of sub-fields. The gray scale of a liquid crystal element is controlled by a combination of a sub-field in which voltage application is ON and a sub-field in which voltage application is OFF in the plurality of sub-fields. Moreover, in the liquid crystal element, a driving of temporally switching the polarity of an applied voltage is performed for preventing the image sticking or degradation of liquid crystal. Ideally, it is desirable that after performing writing with a positive voltage, writing with a negative voltage is performed for the same time. Therefore, one frame is divided into halves, and gray-scale control is performed using sub-fields included in the half of the frame.

In recent years, techniques for performing 3D display (stereoscopic display) have been developed. JP-A-9-138384 discloses a technique for time-divisionally displaying a left-eye image and a right-eye image. A user visually recognizes the video through glasses with shutters. The shutter of a right-eye portion of the glasses is closed when the left-eye image is displayed, while the shutter of a left-eye portion of the glasses is closed when the right-eye image is displayed. With the use of the device, different images are visually recognized respectively with the left eye and the right eye, so that 3D display is perceived.

For example, when a sub-field driving method is adopted as a gray-scale controlling method in performing 3D display using the glasses described above, the number of sub-fields capable of being used for the gray-scale control is reduced to half compared to the case of 2D display. The number of gray scales capable of being expressed in the sub-field driving correlates with the number of sub-fields, so that a reduction in the number of sub-fields means a reduction in the number of gray scales capable of being expressed. This is not a problem which is limited to the case of performing 3D display, but is an essential problem of the sub-field driving method in which a limited time as one frame is divided into a finite number of sub-fields for driving.

SUMMARY

An advantage of some aspects of the invention is to provide a technique for increasing the number of gray scales capable of being expressed in a sub-field driving method.

An aspect of the invention provides an electro-optic device including: a plurality of electro-optic elements each of which expresses a gray scale corresponding to a supplied signal; a storage unit which stores a first table and a second table, the first table including a plurality of pairs of a gray-scale value and a sub-field code indicating a combination of ON and OFF for a sub-fields, the second table including a plurality of pairs of a gray-scale value and a sub-field code indicating a combination of ON and OFF for b (b>a) sub-fields; an input unit which receives a video signal including a first image and a second image each expressed by the gray-scale values of a plurality of pixels, the video signal indicating a plurality of images divided into frames; a converting unit which converts, for object pixels as objects in the plurality of pixels, the gray-scale value of the object pixel into the sub-field code using the second table when a difference in gray-scale value between the first image and the second image is less than a threshold value, while converting the gray-scale value of the object pixel into the sub-field code using the first table when the difference in gray-scale value between the first image and the second image is the threshold value or more; and a driving unit which supplies, in each of a plurality of sub-fields obtained by dividing a period for displaying an image of one frame, a signal corresponding to the sub-field code converted by the converting unit to drive the plurality of electro-optic elements.

According to the electro-optic device, the number of gray scales capable of being expressed can be increased compared to the case of using only the first table in a sub-field driving method.

In a preferred aspect, the first image may be a right-eye image, the second image may be a left-eye image, and the object pixels may be pixels of the right-eye image and the left-eye image in a single frame.

According to this electro-optic device, when a 3D video is displayed in a sub-field driving method, the number of gray scales capable of being expressed can be increased compared to the case of using only the first table.

In another preferred aspect, the driving unit may perform polarity inversion driving in each of the right-eye image and the left-eye image in a single frame.

According to this electro-optic device, while balancing the polarity in a single frame, the number of gray scales capable of being expressed can be increased compared to the case of using only the first table.

In still another preferred aspect, the equation of b=2a may be satisfied.

According to this electro-optic device, the number of gray scales capable of being expressed can be increased to that corresponding to a doubled sub-field code length compared to the case of using only the first table.

In further another preferred aspect, the response time of the electro-optic element may be a time corresponding to c (c<a) sub-fields, and the equation of b=2a+c may be satisfied.

According to this electro-optic device, the number of gray scales capable of being expressed can be increased to that corresponding to a doubled sub-field code length, compared to the case of using only the first table, in consideration of the response time of the electro-optic element.

Another aspect of the invention provides an electronic apparatus including the electro-optic device according to any of the aspects.

According to the electronic apparatus, the number of gray scales capable of being expressed can be increased compared to the case of using only the first table in a sub-field driving method.

Still another aspect of the invention provides a method for driving an electro-optic device including a plurality of electro-optic elements each of which expresses a gray scale corresponding to a supplied signal, and a storage unit which stores a first table and a second table, the first table including a plurality of pairs of a gray-scale value and a sub-field code indicating a combination of ON and OFF for a sub-fields, the second table including a plurality of pairs of a gray-scale value and a sub-field code indicating a combination of ON and OFF for b (b>a) sub-fields, the driving method including: receiving a video signal including a first image and a second image each expressed by the gray-scale values of a plurality of pixels, the video signal indicating a plurality of images divided into frames; converting, for object pixels as objects in the plurality of pixels, the gray-scale value of the object pixel into the sub-field code using the second table when a difference in gray-scale value between the first image and the second image is less than a threshold value, while converting the gray-scale value of the object pixel into the sub-field code using the first table when the difference in gray-scale value between the first image and the second image is the threshold value or more; and supplying, in each of a plurality of sub-fields obtained by dividing a period for displaying an image of one frame, a signal corresponding to the converted sub-field code to drive the plurality of electro-optic elements.

According to the driving method, the number of gray scales capable of being expressed can be increased compared to the case of using only the first table in a sub-field driving method.

BRIEF DESCRIPTION OF THE DRAWINGS

The invention will be described with reference to the accompanying drawings, wherein like numbers reference like elements.

FIG. 7 shows the configuration of a video indicated by a video signal Vid-in.

FIG. 8 exemplifies an LUT and an LUT.

FIGS. 9A and 9B each show an example of sub-field code writing performed by a separating section.

DESCRIPTION OF EXEMPLARY EMBODIMENTS

Embodiment

1. Configuration

Figure 1:
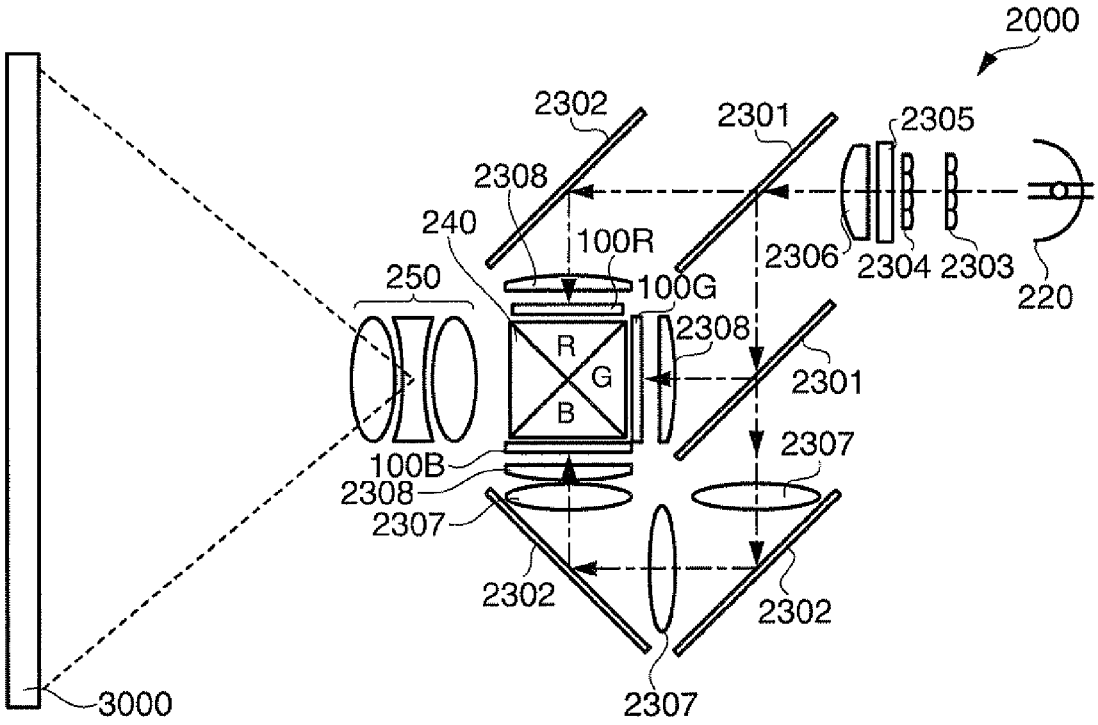
FIG. 1 is a plan view showing the configuration of a projector.

FIG. 1 is a plan view showing the configuration of a projector 2000 (one example of an electronic apparatus) according to one embodiment. The projector 2000 is an apparatus which projects an image corresponding to input video signals onto a screen 3000. In this example, a video projected by the projector 2000 is a 3D video (stereoscopic video). A user visually recognizes a video projected onto the screen 3000 through 3D glasses (not shown). The 3D glasses have a left-eye shutter which blocks or transmits light entering the left eye and a right-eye shutter which blocks or transmits light entering the right eye. Blocking of light entering the eye is referred to as that "the shutter is closed", while transmitting of light is referred to as that "the shutter is opened". The open and closed states are controlled such that the left-eye shutter and the right-eye shutter are independent of each other. With the 3D glasses, a user visually recognizes different videos respectively with the left eye and the right eye to visually recognize a 3D video as a whole.

The projector 2000 has a light valve 210, a lamp unit 220, an optical system 230, a dichroic prism 240, and a projection lens 250. The lamp unit 220 has, for example, a light source of a halogen lamp. The optical system 230 separates light emitted from the lamp unit 220 into a plurality of wavelength bands, for example, three primary colors of R (red), G (green), and B (blue). More specifically, the optical system 230 has dichroic mirrors 2301, mirrors 2302, a first multi-lens 2303, a second multi-lens 2304, a polarization conversion element 2305, a superimposing lens 2306, lenses 2307, and condensing lenses 2308. Projected light emitted from the lamp unit 220 passes through the first multi-lens 2303, the second multi-lens 2304, the polarization conversion element 2305, and the superimposing lens 2306, and is separated into the three primary colors of R (red), G (green), and B (blue) by the two dichroic mirrors 2301 and the three mirrors 2302. The separated lights are introduced to the light valves 210R, 210G, and 210B corresponding to the respective primary colors through the condensing lenses 2308. The B light is introduced through a relay lens system using the three lenses 2307 for preventing the loss due to its long optical path compared to the R light and the G light.

The light valves 210R, 210G, and 210B are each a device which modulates light, and have liquid crystal panels 100R, 100G, and 100B, respectively. On the liquid crystal panel 100, minified images of the respective colors are formed. The minified images formed respectively by the liquid crystal panels 1008, 100G, and 100B, that is, modulated lights are incident from three directions on the dichroic prism 240. The R light and the B light are reflected at the dichroic prism 240 by 90 degrees, while the G light goes straight. Accordingly, after the respective color images are combined, a color image is projected onto the screen 3000 through the projection lens 250.

Since lights respectively corresponding to R, G, and B are incident on the liquid crystal panels 100R, 100G, and 100B through the dichroic mirrors 2301, it is not necessary to dispose a color filter. Moreover, transmission images of the liquid crystal panels 100R and 100B are projected after being reflected by the dichroic prism 240, while a transmission image of the display panel 100G is projected as it is. Accordingly, the horizontal scanning direction of the liquid crystal panels 100R and 100B is opposite to the horizontal scanning direction of the display panel 100G, so that an image whose left and right are inversed is displayed on the liquid crystal panels 100R and 100B.

Figure 2:
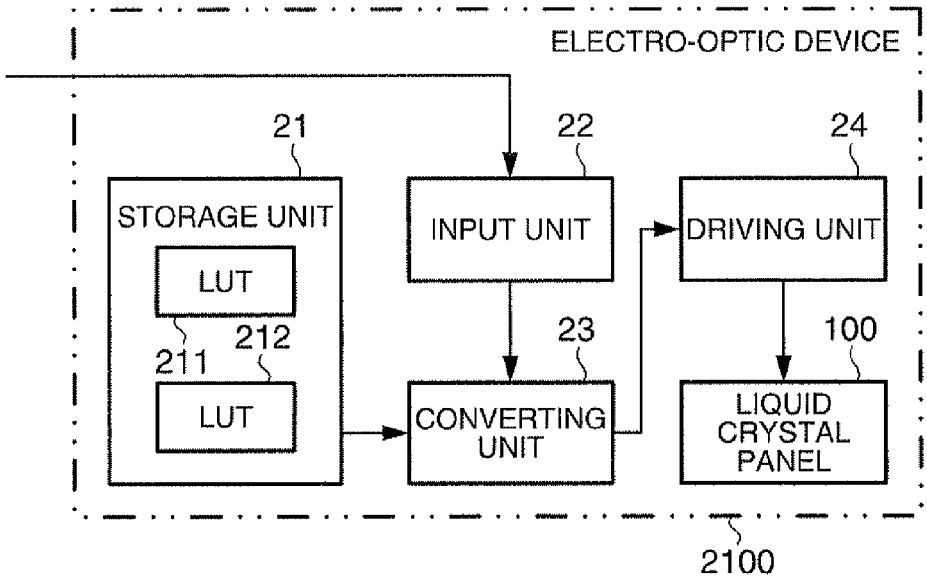
FIG. 2 shows the functional configuration of an electro-optic device.

FIG. 2 shows the functional configuration of an electro-optic device 2100 included in the projector 2000. The projector 2000 has a storage unit 21, an input unit 22, a converting unit 23, a driving unit 24, and the liquid crystal panel 100. The storage unit 21 stores an LUT (Look Up Table) 211 and an LUT 212. The LUT 211 is a table including a plurality of pairs of a gray-scale value and a sub-field code indicating a combination of ON and OFF for a (a is a natural number) sub-fields. The LUT 212 is a table including a plurality of pairs of a gray-scale value and a sub-field code indicating a combination of ON and OFF for b (b is a natural number satisfying the relation of b>a). A video signal is input to the input unit 22. The video signal includes a first image (for example, a left-eye image) and a second image (for example, a right-eye image) each expressed by the gray-scale values of a plurality of pixels. These images are divided into frames. The converting unit 23 converts a gray-scale value indicated by a video signal into a sub-field code. In this example, when a difference in gray-scale value between the first image and the second image is less than a threshold value as for pixels as objects to be processed (hereinafter referred to as "object pixels"), the converting unit 23 converts a gray-scale value into a sub-field code using the LUT 212. When the difference in gray-scale value between the first image and the second image is the threshold value or more, the converting unit 23 converts the gray-scale value of the object pixel into a sub-field code using the LUT 211. The driving unit 24 supplies the liquid crystal panel 100 with a signal corresponding to the sub-field code converted by the converting unit 23 in each sub-field, thereby driving the liquid crystal panel 100.

Figure 3:
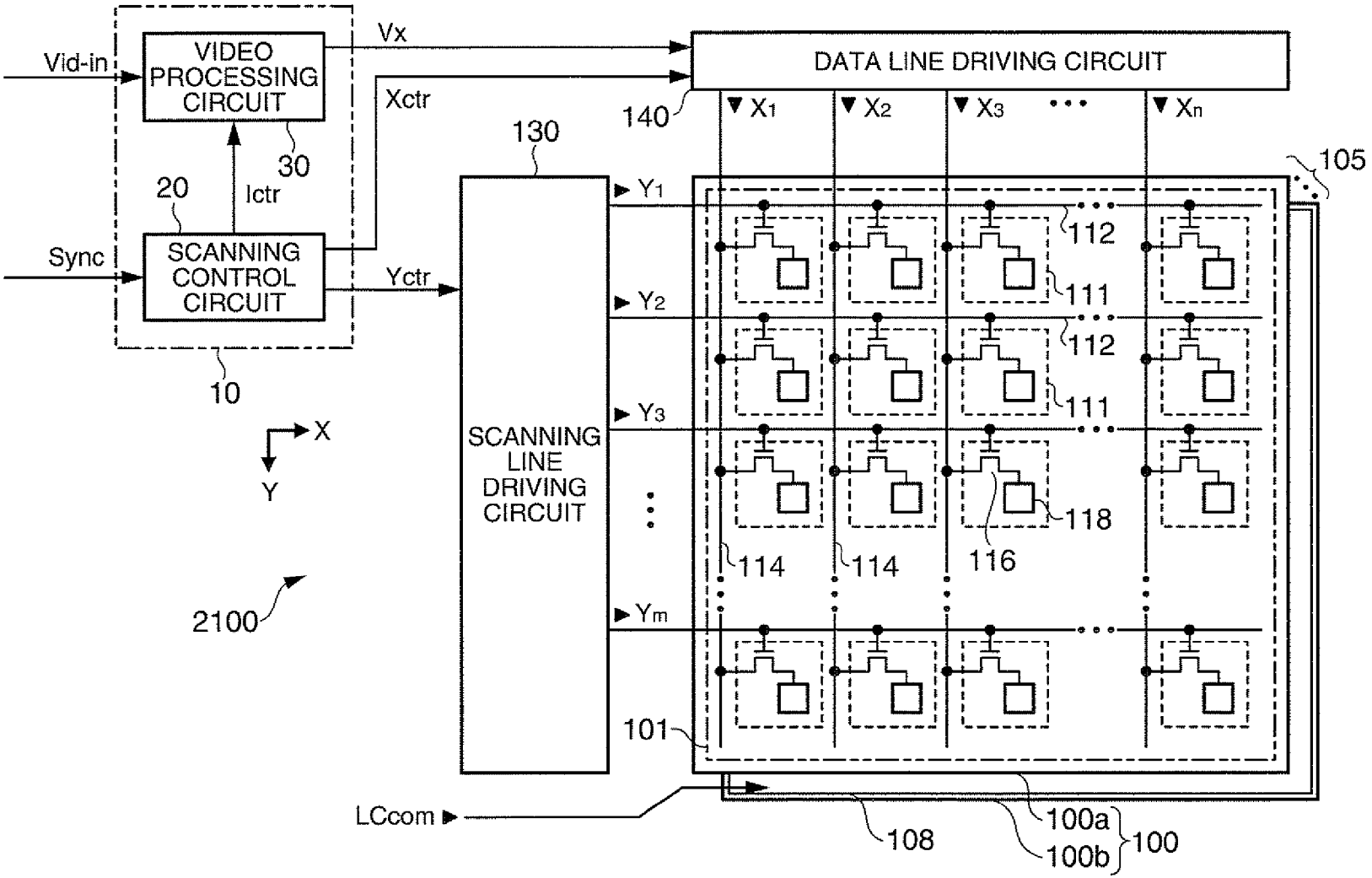
FIG. 3 is a block diagram showing the circuit configuration of the electro-optic device.

FIG. 3 is a block diagram showing the circuit configuration of the electro-optic device 2100. The electro-optic device 2100 has a control circuit 10, the liquid crystal panel 100, a scanning line driving circuit 130, and a data line driving circuit 140. The electro-optic device 2100 is a device which displays, on the liquid crystal panel 100, an image (hereinafter referred to as "input image") indicated by a video signal Vid-in supplied from a higher-level device at a timing based on a synchronizing signal Sync.

The liquid crystal panel 100 is a device which displays an image corresponding to a supplied signal. The liquid crystal panel 100 has a display area 101. A plurality of pixels 111 are arranged in the display area 101. In this example, m rows and n columns of pixels 111 are arranged in a matrix. The liquid crystal panel 100 has an element substrate 100*a*, a counter substrate 100*b*, and a liquid crystal layer 105. The element substrate 100*a* and the counter substrate 100*b* are bonded together with a constant gap therebetween. The liquid crystal layer 105 is interposed between the element substrate 100*a* and the counter substrate 100*b*. On the element substrate 100*a*, m scanning lines 112 and n data lines 114 are disposed. The scanning lines 112 and the data lines 114 are disposed on a surface facing the counter substrate 100*b*. The scanning line 112 and the data line 114 are electrically insulated from each other. The pixel 111 is disposed corresponding to an intersection of the scanning line 112 and the data line 114. The liquid crystal panel 100 has m×n pixels 111. A pixel electrode 118 and a TFT 116 (Thin Film Transistor) are individually disposed corresponding to each of the pixels 111 on the element substrate 100*a*. Hereinafter, when the plurality of scanning lines 112 are distinguished from one another, they are referred to as, beginning at the top in FIG. 3, the scanning lines 112 in first, second, third, . . . , (m−1)th, and mth rows. Similarly, when the plurality of data lines 114 are distinguished from one another, they are referred to as, from the left in FIG. 3, the data lines 114 in first, second, third, . . . , (n−1)th, and nth columns. In FIG. 3, since the counter surface of the element substrate 100*a* is on the back side of the drawing, the scanning lines 112, the data lines 114, the TFTs 116, and the pixel electrodes 118 disposed on the counter surface should be shown by broken lines. However, they are shown by solid lines because it is hard to see if they are shown by broken lines.

A common electrode 108 is disposed on the counter substrate 100*b*. The common electrode 108 is disposed on one surface facing the element substrate 100*a*. The common electrode 108 is common to all of the pixels 111. That is, the common electrode 108 is a so-called solid electrode which is disposed over the substantially entire surface of the counter substrate 100*b*.

Figure 4:
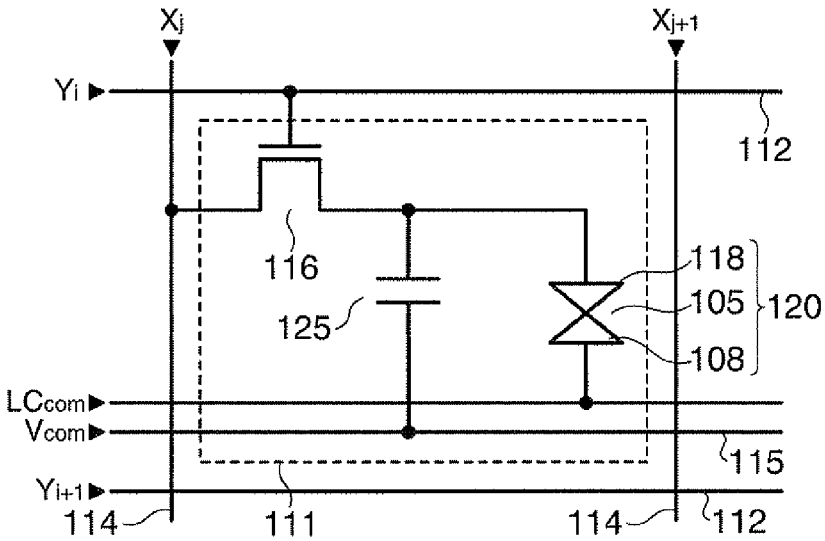
FIG. 4 shows an equivalent circuit of a pixel.

FIG. 4 shows an equivalent circuit of the pixel 111. The pixel 111 has the TFT 116, a liquid crystal element 120, and a capacitive element 125. The TFT 116 is one example of switching means which controls the application of a voltage to the liquid crystal element 120. In this example, the TFT 116 is an n-channel field-effect transistor. The liquid crystal element 120 is an element whose optical state changes according to an applied voltage. In this example, the liquid crystal panel 100 is a transmissive liquid crystal panel, and the optical state to be changed is a transmittance ratio. The liquid crystal element 120 has the pixel electrode 118, the liquid crystal layer 105, and the common electrode 108. In the pixel 111 in the ith row and jth column, the gate and source of the TFT 116 are connected to the scanning line 112 in the ith row and the data line 114 in the jth column, respectively. The drain of the TFT 116 is connected to the pixel electrode 118. The capacitive element 125 is an element which retains a voltage written to the pixel electrode 118. One end of the capacitive element 125 is connected to the pixel electrode 118, while the other end is connected to a capacitive line 115.

When a signal indicating a voltage at H level is input to the scanning line 112 in the ith row, electrical continuity is established between the source and drain of the TFT 116. When electrical continuity is established between the source and drain of the TFT 116, the pixel electrode 118 has the same potential as that of the data line 114 in the jth column (if an on-resistance between the source and drain of the TFT 116 is ignored). A voltage (hereinafter referred to as "data voltage", and a signal indicating the data voltage is referred to as "data signal") corresponding to the gray-scale value of the pixel 111 in the ith row and jth column is applied to the data line 114 in the jth column according to the video signal Vid-in. A common potential LCcom is given to the common electrode 108 by a circuit (not shown). A temporally constant potential Vcom (in this example, Vcom=LCcom) is given to the capacitive line 115 by a circuit (not shown). That is, a voltage corresponding to a difference between the data voltage and the common potential LCcom is applied to the liquid crystal element 120. Hereinafter, description will be made using an example in which the liquid crystal layer 105 is of VA (Vertical Alignment) type with a normally black mode where the gray scale of the liquid crystal element 120 is in a dark state (black state) when no voltage is applied. Unless otherwise noted, a ground potential which is not shown in the drawing is the standard of voltage (0 V).

Referring to FIG. 3 again, the control circuit 10 is a controller which outputs signals for controlling the scanning line driving circuit 130 and the data line driving circuit 140. The control circuit 10 has a scanning control circuit 20 and a video processing circuit 30. The scanning control circuit 20 generates, based on the synchronizing signal Sync, a control signal Xctr, a control signal Yctr, and a control signal Ictr, and outputs the generated signals. The control signal Xctr is a signal for controlling the data line driving circuit 140, and indicates, for example, a timing of supplying a data signal (the commencement of a horizontal scanning period). The control signal Yctr is a signal for controlling the scanning line driving circuit 130, and indicates, for example, a timing of supplying a scanning signal (the commencement of a vertical scanning period). The control signal Ictr is a signal for controlling the video processing circuit 30, and indicates, for example, a timing of signal processing and the polarity of an applied voltage. The video processing circuit 30 processes the video signal Vid-in as a digital signal at the timing indicated by the control signal Ictr, and outputs the processed signal as a data signal Vx as an analog signal. The video signal Vid-in is digital data specifying the gray-scale value of each of the pixels 111. The gray-scale value indicated by this digital data is supplied by the data signal Vx in the order according to a vertical scanning signal, a horizontal scanning signal, and a dot clock signal included in the synchronizing signal Sync.

The scanning line driving circuit 130 is a circuit which outputs a scanning signal Y according to the control signal Yctr. A scanning signal to be supplied to the scanning line 112 in the ith row is referred to as a scanning signal Yi. In this example, the scanning signal Yi is a signal for sequentially and exclusively selecting one scanning line 112 from the m scanning lines 112. The scanning signal Yi is a signal which serves as a selection voltage (H level) for the scanning line 112 to be selected, while serving as a non-selection voltage (L level) for the other scanning lines 112. Instead of the driving of sequentially and exclusively selecting one scanning line 112, a so-called MLS (Multiple Line Selection) driving in which the plurality of scanning lines 112 are simultaneously selected may be used.

The data line driving circuit 140 is a circuit which samples the data signal Vx according to the control signal Xctr to output a data signal X. A data signal to be supplied to the data line 114 in the jth column is referred to as a data signal Xj.

Figure 5:
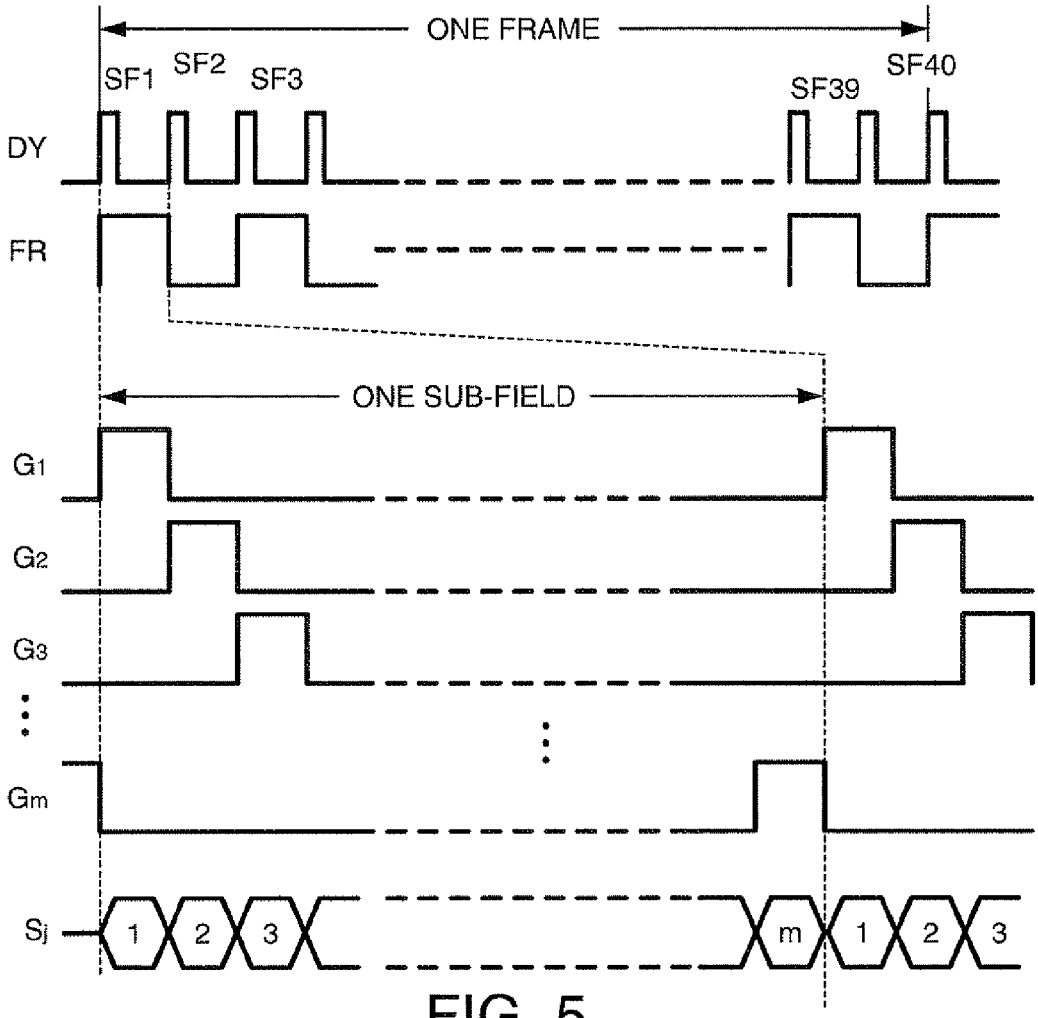
FIG. 5 is a timing diagram showing a method for driving a liquid crystal panel.

FIG. 5 is a timing diagram showing a method for driving the liquid crystal panel 100. An image is rewritten every frame (in this example, a plurality of times in one frame). For example, the frame rate is 60 frames/sec, that is, the frequency of a vertical synchronizing signal (not shown) is 60 Hz, and one frame period (hereinafter simply referred to as "one frame") is 16.7 msec (1/60 sec). The liquid crystal panel 100 is driven by sub-field driving. In the sub-field driving, one frame is divided into a plurality of sub-field periods (hereinafter simply referred to as "sub-fields"). FIG. 5 shows an example in which one frame is divided into 40 sub-fields SF1 to SF40. A start signal DY is a signal indicating the commencement of a sub-field. When a pulse at H level is supplied as the start signal DY, the scanning line driving circuit 130 starts scanning the scanning lines 112, that is, outputs scanning signals Gi ($1 \leq i \leq m$) to the m scanning lines 112. In one sub-field, the scanning signal G is a signal serving sequentially and exclusively as a selection voltage. A scanning signal indicating a selection voltage is referred to as a selection signal, and a scanning signal indicating a non-selection voltage is referred to as a non-selection signal. Moreover, supplying of a selection signal to the scanning line 112 in the ith row is referred to as that "the scanning line 112 in the ith row is selected". A data signal Sj to be supplied to the data line 114 in the jth column is synchronized with a scanning signal. For example, when the scanning line 112 in the ith row is selected, a signal indicating a voltage corresponding to the gray-scale value of the pixel 111 in the ith row and jth column is supplied as the data signal Sj.

For simplifying the description, the description will be made herein using an example in which the response time (response speed) of the liquid crystal element 120 and the shutter of the 3D glasses can be ignored, that is, an example in which the response time of the liquid crystal element 120 and the response time of the shutter are sufficiently short (the response speed is sufficiently fast) relative to a sub-field length.

Figure 6:
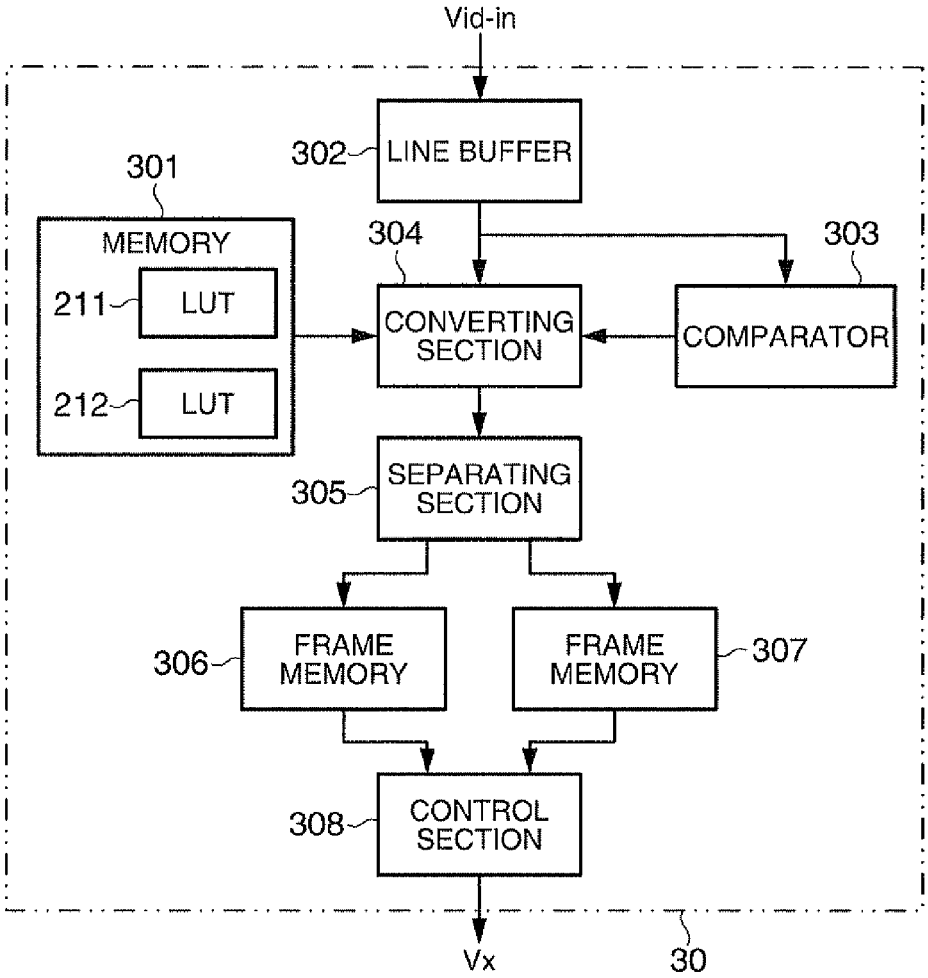
FIG. 6 shows the configuration of a video processing circuit.

FIG. 6 shows the configuration of the video processing circuit 30. The video processing circuit 30 has a memory 301, a line buffer 302, a comparator 303, a converting section 304, a separating section 305, a frame memory 306, a frame memory 307, and a control section 308. The memory 301 is one example of the storage unit 21, and stores the LUT 211 and the LUT 212. The line buffer 302 is one example of the input unit 22, and stores as data an input image corresponding to one row.

Figure 7:
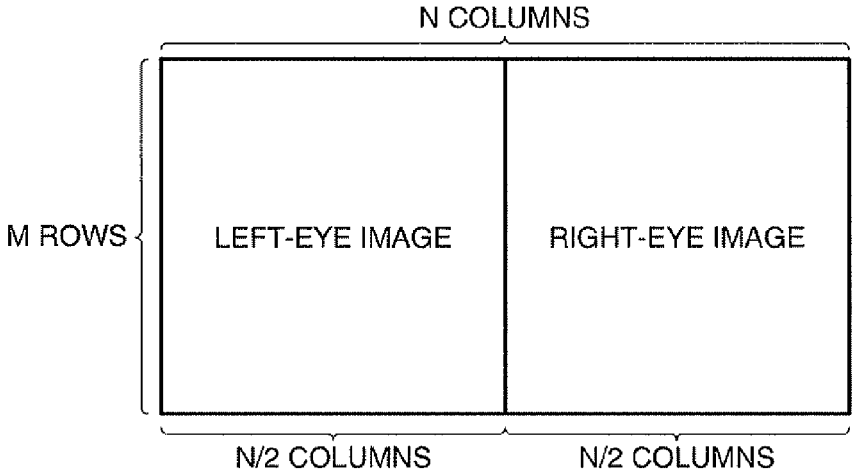

FIG. 7 shows the configuration of an input video. In this example, the input video is a 3D video in a so-called side-by-side format. Images corresponding to one frame are shown in the drawing, where a left-eye image and a right-eye image are arranged left and right. Compared to a 2D image, the left-eye image and the right-eye image are each compressed to ½ in the horizontal direction. That is, the left-eye image and the right-eye image are each composed of m rows and (n/2) columns of pixels, so that the resolution in the horizontal direction is half that of a 2D image.

Referring to FIG. 6 again, the comparator 303 reads, from data stored in the line buffer 302, data of object pixels in a left-eye image and a right-eye image, and compares gray-scale values indicated by these data. The object pixels are pixels at the same position when the left-eye image and the right-eye image are considered as being separate images from each other. For example, when the pixel in the ith row and jth column is an object pixel, a pixel in the ith row and jth column in the left-eye image and a pixel in the ith row and jth column in the right-eye image (the ith row and (n/2+j)th column in a side-by-side image) are each an object pixel. That is, the comparator 303 compares the gray-scale values of pixels of the right-eye image and the left-eye image in a single frame. The comparator 303 outputs a signal indicating whether or not the gray-scale values of object pixels are the same.

The converting section 304 is one example of the converting unit 23, and converts the gray-scale value of an object pixel into a sub-field code. The sub-field code means data indicating a combination (permutation in a narrow sense) of ON and OFF in one group of sub-fields. The conversion from a gray-scale value into a sub-field code is performed with reference to the LUT. In this example, the converting section 304 performs the conversion with reference to the LUT 212 when the signal output from the comparator 303 indicates that the gray-scale values of object pixels are the same, while performing the conversion with reference to the LUT 211 when the signal indicates that the gray-scale values of object pixels are not the same. The converting section 304 outputs the sub-field code of the object pixel.

FIG. 8 exemplifies the LUT 211 and the LUT 212. In this example, each sub-field code included in the LUT 211 indicates a combination of ON ("1") and OFF ("0") for 10 sub-fields. That is, the LUT 211 is an example of a=10, and an SF code is 10-bit data. Moreover, each sub-field code included in the LUT 212 indicates a combination of ON and OFF for 20 sub-fields. That is, the LUT 212 is an example of b=20 (=2a), and an SF code is 20-bit data.

Referring to FIG. 6 again, the separating section 305 separates the sub-field code into the left-eye image and the right-eye image. Specifically, the separating section 305 writes the sub-field code of the left-eye image of an object pixel to the frame memory 306, and writes the sub-field code of the right-eye image to the frame memory 307. The frame memory 306 is a memory which stores sub-field codes of left-eye images. The frame memory 307 is a memory which stores sub-field codes of right-eye images. In this example, the frame memory 306 and the frame memory 307 each have storage areas corresponding to m rows and n columns of pixels. For example, when the pixel in the ith row and jth column is an object pixel, the separating section 305 writes the sub-field code of a left-eye image of the object pixel to the storage areas of the frame memory 306 corresponding to pixels in the ith row and (2j)th column and the ith row and (2j+1)th column. Further, the separating section 305 writes the sub-field code of a right-eye image of the object pixel to the storage areas of the frame memory 307 corresponding to the pixels in the ith row and (2j)th column and the ith row and (2j+1)th column.

FIGS. 9A and 9B each show an example of sub-field code writing performed by the separating section 305. In this example, each of the frame memory 306 and the frame memory 307 has a storage area for storing 20-bit data as a storage area corresponding to each pixel. When the gray-scale values of a left-eye image and a right-eye image are different from each other (FIG. 9A), the separating section 305 writes a 10-bit sub-field code repeatedly twice to the frame memory 306 and the frame memory 307. When the gray-scale values of a left-eye image and a right-eye image are the same (FIG. 99), the separating section 305 writes a 20-bit sub-field code to the frame memory 306 and the frame memory 307.

The control section 308 reads a sub-field code from the frame memory 306 or the frame memory 307, and outputs the data signal Vx corresponding to the read sub-field code. More specifically, the control section 308 sequentially reads a 20-bit sub-field code at the timing indicated by the control signal Ictr, and outputs the data signal Vx corresponding to the read sub-field code.

2. Operation

Figure 10:
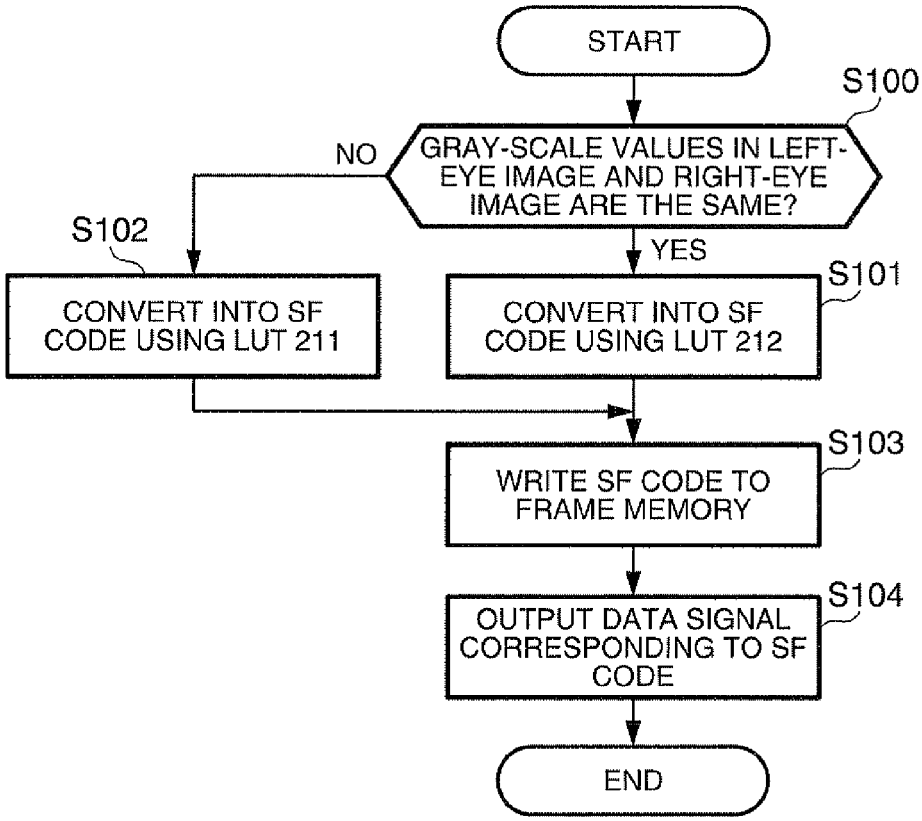
FIG. 10 is a flow diagram showing the operation of the projector.

FIG. 10 is a flow diagram showing the operation of the projector 2000. In Step S100, the comparator 303 determines whether or not the gray-scale values of object pixels in a left-eye image and a right-eye image are the same. If it is determined that the gray-scale values of the object pixels are the same (Step S100: YES), the converting section 304 converts the gray-scale value into a sub-field code with reference to the LUT 212 (Step S101). If it is determined that the gray-scale values of the object pixels are not the same (Step S100: NO), the converting section 304 converts the gray-scale values into sub-field codes with reference to the LUT 211 (Step S102).

In Step S103, the separating section 305 writes the sub-field code of the object pixel to the frame memory 306 and the frame memory 307. At the timing indicated by the control signal Ictr output from the scanning control circuit 20, the control section 308 outputs the data signal Vx corresponding to the sub-field code stored in the frame memory 306 or the frame memory 307 (Step S104).

Here, a process when the gray-scale values of object pixels in a left-eye image and a right-eye image are different will be described using the example of FIG. 9A.

The line buffer 302 stores the gray-scale values of a pixel group belonging to a row as an object to be processed in an input image. The comparator 303 reads the gray-scale values of two pixels corresponding to object pixels in the gray-scale values stored in the line buffer 302. The two pixels corresponding to the object pixels are a pixel in the ith row and jth column and a pixel in the ith row and (n/2+j)th column in the input image. The comparator 303 compares the read two gray-scale values, and outputs a signal indicating the comparison result to the converting section 304. In this example, the comparator 303 outputs a signal indicating that the gray-scale values of these two pixels are different (that is, that the gray-scale values of the object pixels are not the same).

When the signal indicating that the gray-scale values of the object pixels are not the same is input, the converting section 304 converts the gray-scale values into sub-field codes with reference to the LUT 211. The process is performed specifically as follows. First, the converting section 304 reads from the line buffer 302 the gray-scale value of the pixel in the ith row and jth column as the gray-scale value of a left-eye image. The converting section 304 reads a sub-field code corresponding to the gray-scale value from the LUT 211 stored in the memory 301. In this example, a sub-field code "0000000001" is read. The converting section 304 outputs to the separating section 305 the read sub-field code, a flag indicating that the length of the sub-field code is 10 bits, and a flag indicating that the sub-field code is that of the left-eye image.

When the sub-field code of the left-eye image is input, the separating section 305 writes the input sub-field code to the storage areas corresponding to the pixels in the ith row and (2j)th column and the ith row and (2j+1)th column of the frame memory 306. In the frame memory 306, the storage area of each pixel is 20 bits. When the flag indicating that the length of the sub-field code is 10 bits is input, the separating section 305 writes the input 10-bit sub-field code to each of the first-half 10-bit storage area and the second-half 10-bit storage area of the 20-bit storage area. That is, the separating section 305 writes the 10-bit sub-field code repeatedly twice to the frame memory 306. In this example, in the frame memory 306, a 20-bit data of "00000000010000000001" is written to each of the storage areas of the pixels in the ith row and (2j)th column and the ith row and (2j+1)th column.

Next, the converting section 304 reads from the line buffer 302 the gray-scale value of the pixel in the ith row and (n/2+j)th column as the gray-scale value of the right-eye image. The converting section 304 reads a sub-field code corresponding to the gray-scale value from the LUT 211 stored in the memory 301. In this example, a sub-field code "0000000111" is read. The converting section 304 outputs to the separating section 305 the read sub-field code, the flag indicating that the length of the sub-field code is 10 bits, and a flag indicating that the sub-field code is that of the right-eye image.

When the sub-field code of the right-eye image is input, the separating section 305 writes the input sub-field code to the storage areas corresponding to the pixels in the ith row and (2j)th column and the ith row and (2j+1)th column of the frame memory 307. In the frame memory 307, the storage area of each pixel is 20 bits. When the flag indicating that the length of the sub-field code is 10 bits is input, the separating section 305 writes the input 10-bit sub-field code to each of the first-half 10-bit storage area and the second-half 10-bit storage area of the 20-bit storage area. That is, the separating section 305 writes the 10-bit sub-field code repeatedly twice to the frame memory 307. In this example, in the frame memory 307, a 20-bit data of "00000001110000000111" is written to each of the storage areas of the pixels in the ith row and (2j)th column and the ith row and (2j+1)th column.

By converting a gray-scale value into a sub-field code while sequentially updating an object pixel, the sub-field codes of the row as an object to be processed are written to the frame memory 306 and the frame memory 307. By sequentially updating the row as an object to be processed, the sub-field codes of an image of one frame are written to the frame memory 306 and the frame memory 307.

A left-eye image and a right-eye image are alternately displayed time-divisionally. That is, one frame is divided into a (sub) frame for displaying a left-eye image (hereinafter referred to as "left-eye frame") and a (sub) frame for displaying a right-eye image (hereinafter referred to as "right-eye frame"). In the left-eye frame, the control section 308 sequentially reads data from the frame memory 306, and outputs as the data signal Vx a signal of a voltage corresponding to the read data. In this example, since data of a first sub-field is "0" (OFF), a signal of a voltage (for example, 0 V) corresponding to OFF is output as the data signal Vx in the first sub-field. Alternatively, since data of an eighth sub-field is "1" (ON), a signal of a voltage (for example, 5V) corresponding to ON is output as the data signal Vx in the eighth sub-field.

Figure 11:
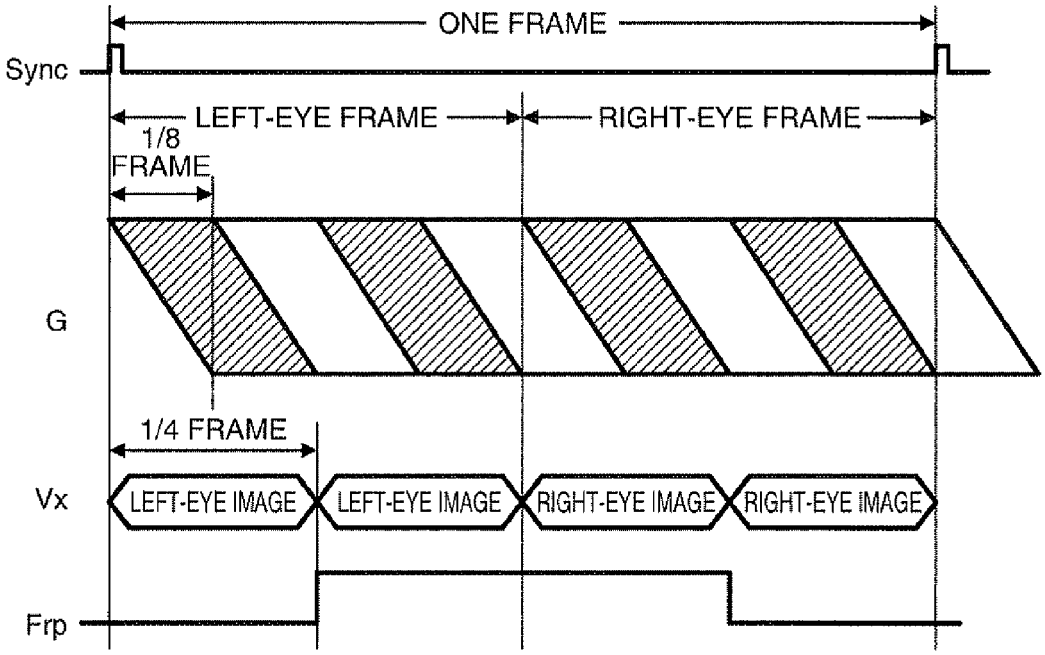
FIG. 11 is one example of a timing diagram showing the operation of the projector.

FIG. 11 is one example of a timing diagram showing the operation of the projector 2000. FIG. 11 shows an example in which the gray-scale values of object pixels in a left-eye image and a right-eye image are different. In this example, the scanning line 112 is scanned eight times in one frame. One scan is ⅛ frame, that is, performed in 2.08 msec. In the scanning signal G, portions regarding the odd-numbered scans are hatched, and portions regarding the even-numbered scans are outlined. One frame is divided into 40 sub-fields. The number of scans and the number of sub-fields per frame are the same also in the following examples.

In this example, the first ½ frame of one frame is a left-eye frame, and the second ½ frame is a right-eye frame. Each of the left-eye frame and the right-eye frame is divided into halves (that is, ¼ frames). Gray-scale expression is performed using ¼ frame, that is, 10 sub-fields. Sub-field codes used for this gray-scale expression are obtained by conversion using the LUT 211. In a polarity inversion signal Frp, the first ¼ frame and the last ¼ frame are at L level, and the middle ½ frame is at H level.

In the first ¼ frame, a left-eye image (in the example of the object pixel of FIG. 9A, data of "0000000001") is written by applying a negative voltage. In the second ¼ frame, the left-eye image (in the example of the object pixel of FIG. 9A, the data of "0000000001") is written by applying a positive voltage. The left-eye images written in these two periods are the same. Accordingly, in the first ½ frame, a time in which a positive voltage is applied to the liquid crystal element 120 is equal to a time in which a negative voltage is applied, so that the polarity is balanced. Next, in the third ¼ frame, a right-eye image (in the example of the object pixel of FIG. 9A, data of "0000000111") is written by applying a positive voltage. In the fourth ¼ frame, the right-eye image (in the example of the object pixel of FIG. 9A, the data of "0000000111") is written by applying a negative voltage. The right-eye images written in these two periods are the same. Accordingly, in the second ½ frame, a time in which a positive voltage is applied to the liquid crystal element 120 is equal to a time in which a negative voltage is applied, so that the polarity is balanced.

Next, a process when the gray-scale values of object pixels in a left-eye image and a right-eye image are the same will be described using the example of FIG. 9B.

The line buffer 302 stores the gray-scale values of a pixel group belonging to a row as an object to be processed in an input image. The comparator 303 reads the gray-scale values of two pixels corresponding to object pixels in the gray-scale values stored in the line buffer 302. The two pixels corresponding to the object pixels are a pixel in the ith row and jth column and a pixel in the ith row and (n/2+j)th column in the input image. The comparator 303 compares the read two gray-scale values, and outputs a signal indicating the comparison result to the converting section 304. In this example, the comparator 303 outputs a signal indicating that the gray-scale values of these two pixels are the same (that is, that the gray-scale values of the object pixels are the same).

When the signal indicating that the gray-scale values of the object pixels are the same is input, the converting section 304 converts the gray-scale value into a sub-field code with reference to the LUT 212. The process is performed specifically as follows. First, the converting section 304 reads from the line buffer 302 the gray-scale value of the pixel in the ith row and jth column as the gray-scale value of a left-eye image. The converting section 304 reads a sub-field code corresponding to the gray-scale value from the LUT 212 stored in the memory 301. In this example, a sub-field code "00000000000000000001" is read. The converting section 304 outputs to the separating section 305 the read sub-field code, a flag indicating that the length of the sub-field code is 20 bits, and a flag indicating that the sub-field code is common to the left-eye image and a right-eye image.

When the sub-field code common to the left-eye image and the right-eye image is input, the separating section 305 writes the input sub-field code to the storage areas of the frame memory 306 corresponding to the pixels in the ith row and (2j)th column and the ith row and (2j+1)th column, and the storage areas of the frame memory 307 corresponding to the pixels in the ith row and (2j)th column and the ith row and (2j+1)th column. In this example, in the frame memory 306 and the frame memory 307, a 20-bit data of "00000000000000000001" is written to each of the storage areas of the pixels in the ith row and (2j)th column and the ith row and (2j+1)th column.

By converting a gray-scale value into a sub-field code while sequentially updating an object pixel, the sub-field codes of the row as an object to be processed are written to the frame memory 306 and the frame memory 307. By sequentially updating the row as an object to be processed, the sub-field codes of an image of one frame are written to the frame memory 306 and the frame memory 307.

In a left-eye frame, the control section 308 sequentially reads data from the frame memory 306, and outputs as the data signal Vx a signal of a voltage corresponding to the read data. In this example, since data of a first sub-field is "0" (OFF), a signal of a voltage corresponding to OFF is output as the data signal Vx in the first sub-field. Alternatively, since data of a twentieth sub-field is "1", a signal of a voltage corresponding to ON is output as the data signal Vx in the twentieth sub-field.

Figure 12:
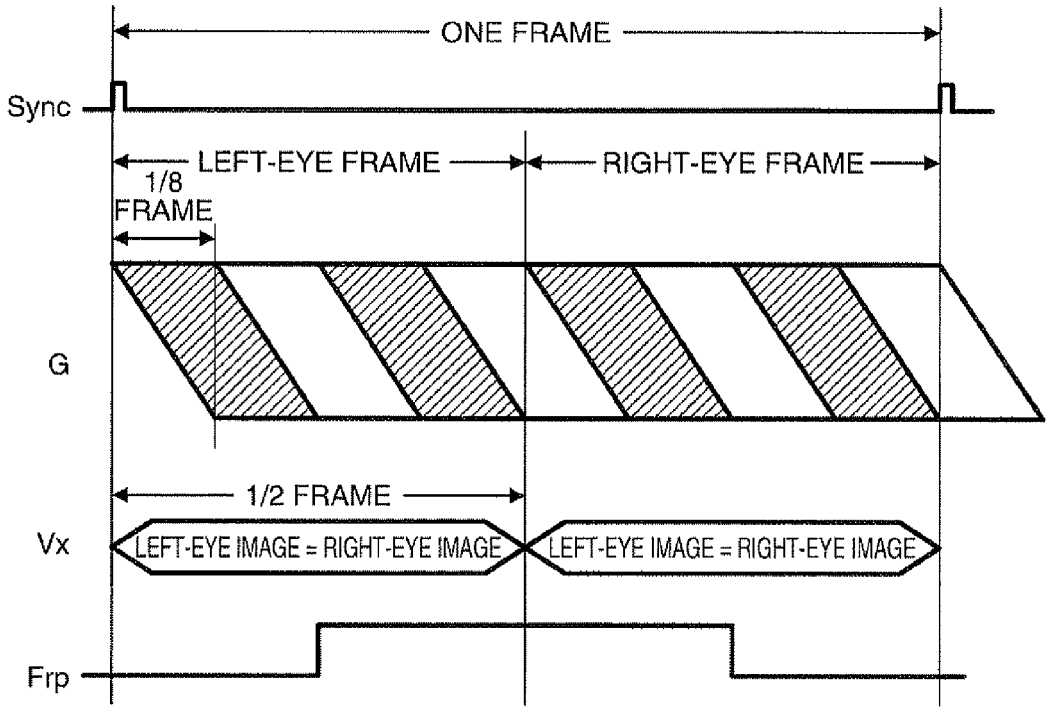
FIG. 12 is another example of a timing diagram showing the operation of the projector.

FIG. 12 is another example of a timing diagram showing the operation of the projector 2000. FIG. 12 shows an example in which the gray-scale values of object pixels in a left-eye image and a right-eye image are the same. For each of the left-eye image and the right-eye image, gray-scale expression is performed using ½ frame, that is, 20 sub-fields. Sub-field codes used for this gray-scale expression are obtained by conversion using the LUT 212. In the polarity inversion signal Frp, the first ¼ frame and the last ¼ frame are at L level, and the middle ½ frame is at H level.

In this example, in the first ¼ frame, the first-half 10-bit data ("0000000000") of a 20-bit sub-field code ("00000000000000000001" in the example of FIG. 9B) is written. In this case, the polarity of a voltage to be applied to the liquid crystal element 120 is negative. In the second ¼ frame, the second-half 10-bit data ("0000000001") of the 20-bit sub-field code is written. In this case, the polarity of a voltage to be applied to the liquid crystal element 120 is positive. In the third ¼ frame, the first-half 10-bit data ("0000000000") of a 20-bit sub-field code is written. In this case, the polarity of a voltage to be applied to the liquid crystal element 120 is positive. In the fourth ¼ frame, the second-half 10-bit data ("0000000001") of the 20-bit sub-field code is written. In this case, the polarity of a voltage to be applied to the liquid crystal element 120 is negative.

Since the gray-scale values of the left-eye image and the right-eye image are the same, an image displayed in the first ½ frame and an image displayed in the second ½ frame are the same. Since the sub-field code is the same between the first ¼ frame and the third ¼ frame, and the polarity of a voltage to be applied to the liquid crystal element 120 is different between them, the polarity is balanced. The same applies to the second ¼ frame and the fourth ¼ frame.

For pixels whose gray-scale values in a left-eye image and a right-eye image are the same, gray-scale expression is performed using a sub-field code longer than that of pixels whose gray-scale values are not the same (that is, the number of gray scales is increased). A portion where the gray-scale values of a left-eye image and a right-eye image are the same is likely a still image portion where stereoscopic vision is not provided. The portion where stereoscopic vision is not provided easily makes a user feel an effect of an increase in the number of gray scales than a portion where stereoscopic vision is provided.

Figure 13:
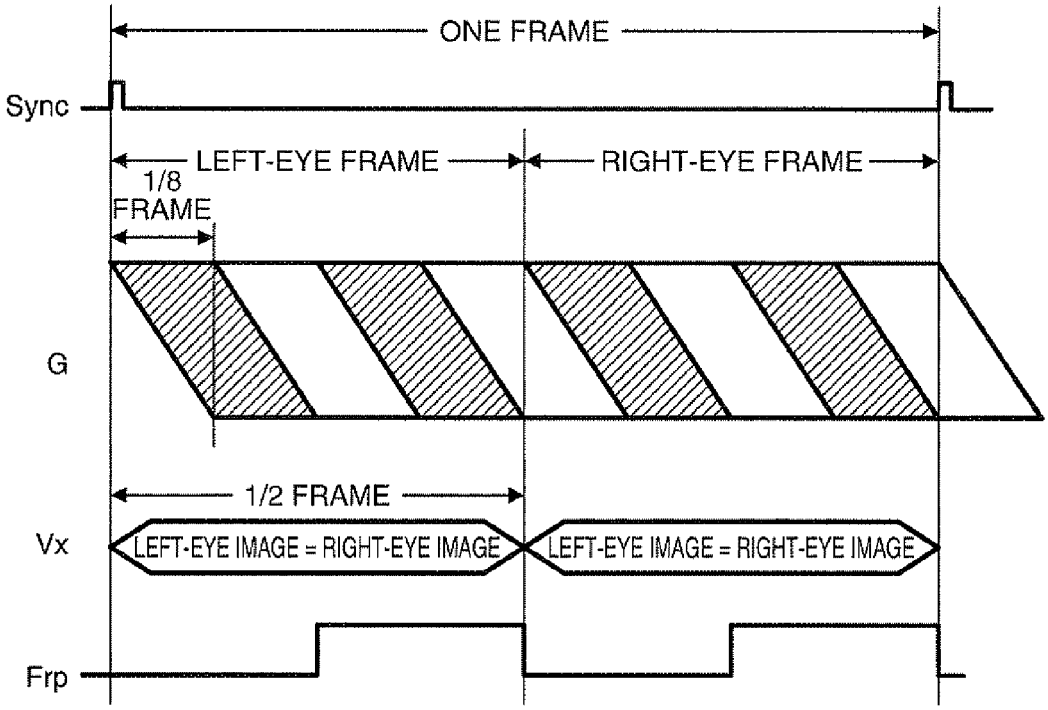
FIG. 13 is an example of a timing diagram showing operation according to a comparative example.

FIG. 13 is an example of a timing diagram showing operation according to a comparative example. FIG. 13 is similar to the example of FIG. 12, excepting that the polarity inversion signal Frp is at L level in the first and third ¼ frames, and at H level in the second and fourth ¼ frames. In this example, a sub-field code is the same between the first ¼ frame of the first ½ frame and the first ¼ frame of the second ½ frame, and the polarity of a voltage to be applied to the liquid crystal element 120 is also the same between them, and therefore the polarity is not balanced.

In contrast to this, according to the projector 2000, the polarity in a single frame is balanced.

MODIFIED EXAMPLES

The invention is not limited to the above-described embodiment, but can be implemented in various modes. Hereinafter, some modified examples will be described. Two or more of the modified examples described below may be used in combination.

Modified Example 1

Figure 14:
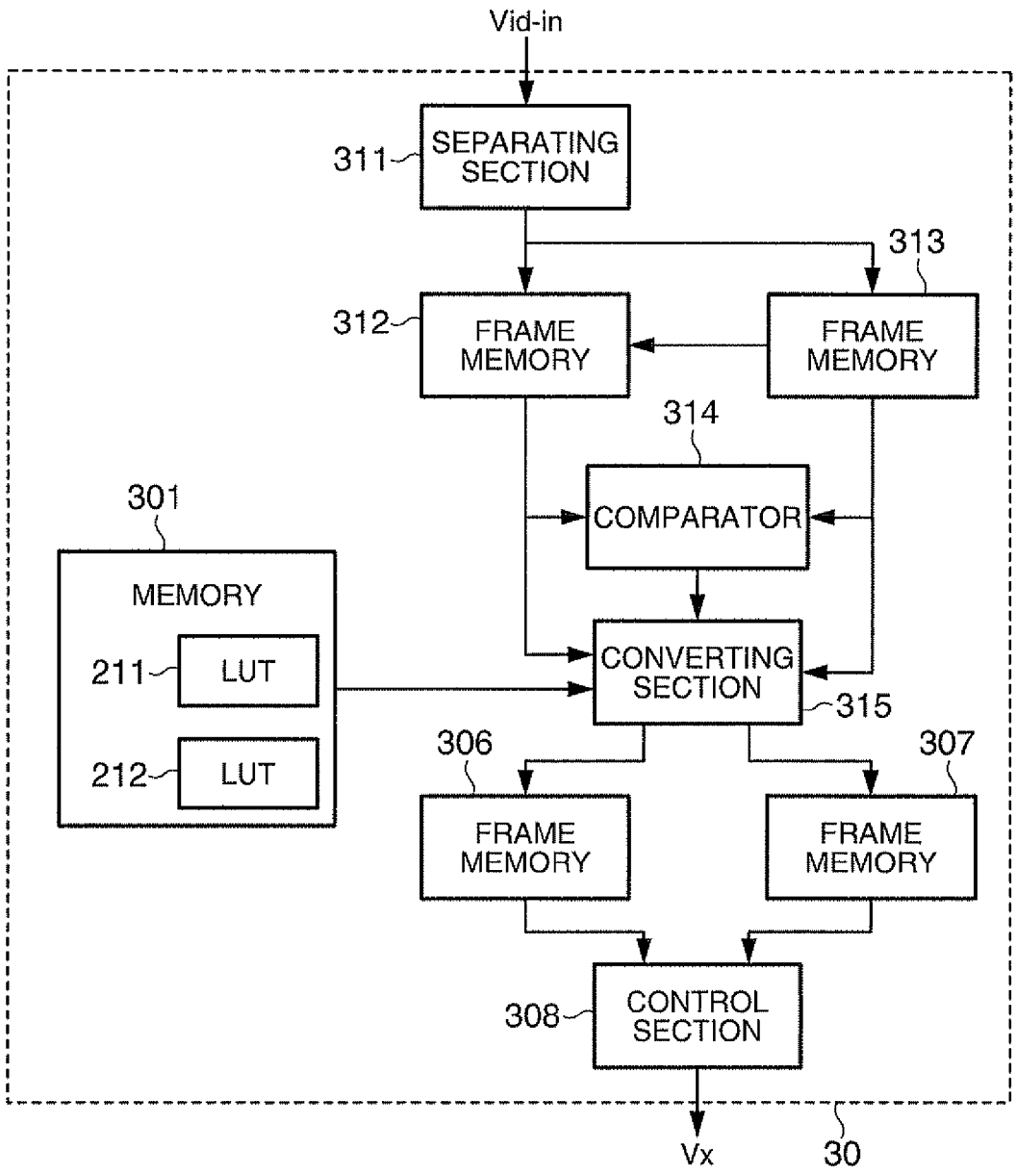
FIG. 14 shows the configuration of the video processing circuit according to Modified Example 1.

FIG. 14 shows the configuration of the video processing circuit 30 according to Modified Example 1. In Modified Example 1, the video processing circuit 30 has the memory 301, the frame memory 306, the frame memory 307, the control section 308, a separating section 311, a frame memory 312, a frame memory 313, a comparator 314, and a converting section 315. In the embodiment, the video signal Vid-in indicates a 3D video in a side-by-side format. However, in Modified Example 1, the video signal Vid-in indicates a 3D video in a frame sequential format. More specifically, the video signal Vid-in indicates a video in which a left-eye image and a right-eye image are alternately switched at 120 Hz. The separating section 311 separates an image indicated by the video signal Vid-in into a left-eye image and a right-eye image. The separating section 311 writes the left-eye image to the frame memory 312 and the right-eye image to the frame memory 313. The frame memory 312 and the frame memory 313 are memories which respectively store the left-eye image and the right-eye image corresponding to one frame. For each of the frame memory 312 and the frame memory 313, a line buffer (memory which stores data corresponding to one row) may be used instead of a frame memory.

The comparator 314 reads data of the gray-scale values of object pixels from the frame memory 312 and the frame memory 313, and determines whether or not the gray-scale values are the same. The comparator 314 outputs a signal indicating whether or not the gray-scale values of the object pixels in the left-eye image and the right-eye image are the same. The converting section 315 converts the gray-scale value into a sub-field code with reference to the LUT 212 when the signal output from the comparator 314 indicates that the gray-scale values of the object pixels are the same, while converting with reference to the LUT 211 when the signal indicates that the gray-scale values of the object pixels are not the same. The converting section 304 writes the sub-field code obtained by conversion to the frame memory 306 and the frame memory 307. The frame memory 306, the frame memory 307, and the control section 308 have been already described in the embodiment.

According to Modified Example 1, not only in a 3D video in a side-by-side format but also in a 3D video in a frame sequential format, gray-scale expression is performed while balancing the polarity in a single frame, and using a longer sub-field code for pixels whose gray-scale values in a left-eye image and a right-eye image are the same (that is, the number of gray scales is increased).

Modified Example 2

In the embodiment, an example in which gray-scale expression is performed fully using half of each of a left-eye frame and a right-eye frame, that is, ¼ frame (=10 sub-fields) has been described. However, gray-scale expression may be performed using only one portion of ¼ frame. In the embodiment, an example in which the response time (response speed) of each of the liquid crystal element 120 and the shutter of the 3D glasses for viewing a 3D video can be ignored, that is, an example in which the response time of the liquid crystal element 120 and the response time of the shutter are sufficiently fast relative to a sub-field length has been described. However, the response time cannot be ignored in some cases depending on the configurations of the liquid crystal element 120 and the shutter. For example, when the response time of the liquid crystal element 120 is a time corresponding to c ($c<a$) sub-fields, the equation of $b=2a+c$ may be satisfied.

Figure 15:
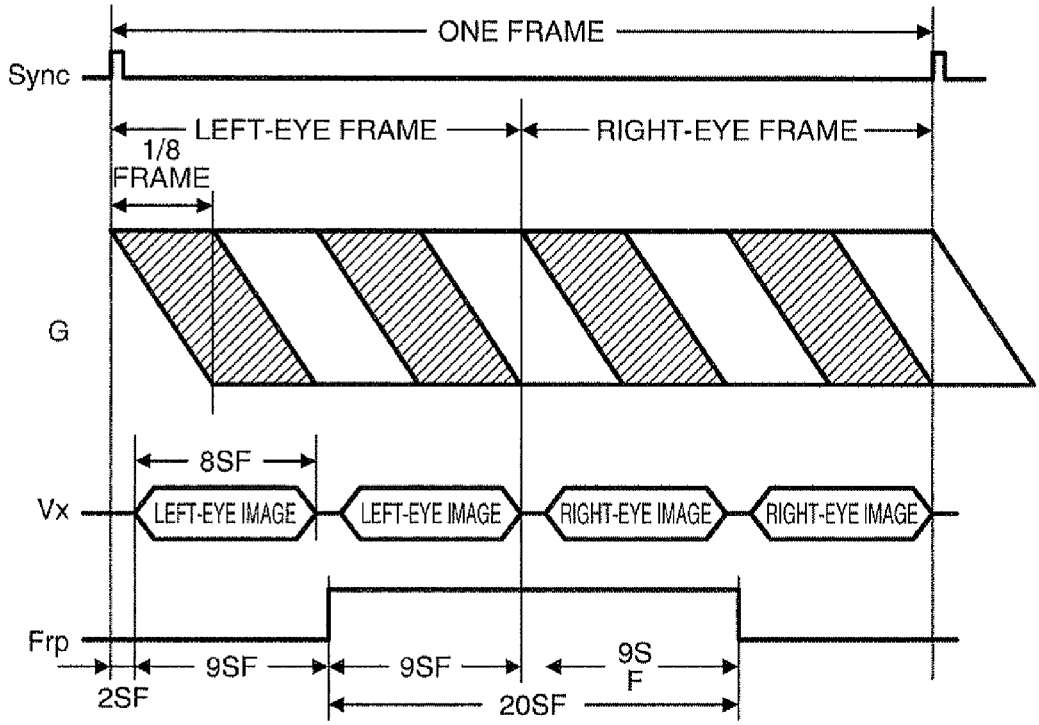
FIG. 15 is one example of a timing diagram showing operation according to Modified Example 2.

FIG. 15 is a timing diagram showing the operation of the projector 2000 according to Modified Example 2. FIG. 15 shows an example in which the gray-scale values of object pixels in a left-eye image and a right-eye image are different. For example, when the response time of the liquid crystal element 120 can be ignored, but the response time of the shutter of the 3D glasses is about two sub-fields, which cannot be ignored ($c=2$), two sub-fields of ¼ frame cannot be used for gray-scale expression. In this case, gray-scale expression is performed using eight sub-fields. That is, each sub-field code stored in the LUT 211 is 8-bit data ($a=8$). Moreover, the polarity inversion signal Frp changes from L level to H level after a time corresponding to 11 sub-fields has elapsed from the start point of a frame. The polarity inversion signal Frp changes to L level after retaining H level for a time corresponding to 20 sub-fields. It is sufficient that the polarity inversion signal Frp switches during the response time of the shutter.

Figure 16:
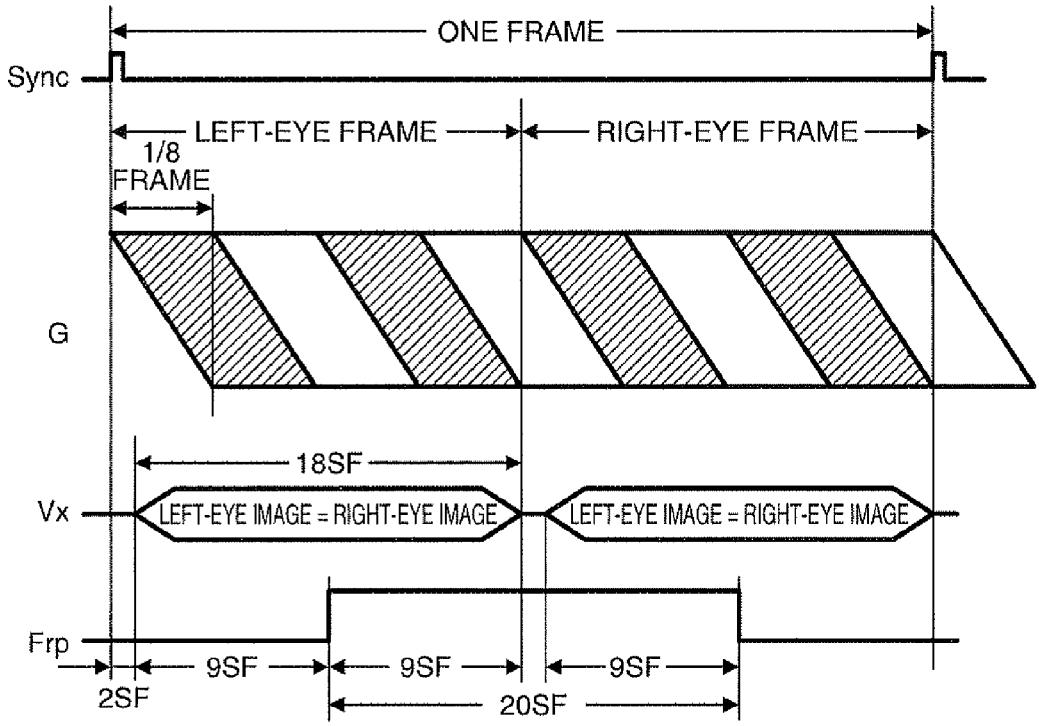
FIG. 16 is another example of a timing diagram showing operation according to Modified Example 2.

FIG. 16 is a timing diagram showing the operation of the projector 2000 according to Modified Example 2. FIG. 16 shows an example in which the gray-scale values of object pixels in a left-eye image and a right-eye image are the same when the response time conditions are similar to those of FIG.

15. In this case, gray-scale expression is performed using 18 sub-fields. That is, each sub-field code stored in the LUT 212 is 18-bit data (b=18=2a+c).

According to Modified Example 2, even when the response time of the shutter of the 3D glasses cannot be ignored, gray-scale expression is performed while balancing the polarity in a single frame, and using a longer sub-field code for pixels whose gray-scale values in a left-eye image and a right-eye image are the same (that is, the number of gray scales is increased).

Modified Example 3

A video indicated by the video signal Vid-in is not limited to a 3D video but may be a 2D video. In this case, a first image is an image of a kth frame, and a second image is an image of a (k+1)th frame. According to Modified Example 3, even in a 2D video, gray-scale expression is performed using a longer sub-field code for a pixel whose gray-scale values in two continuous frames are the same (that is, the number of gray scales is increased).

Modified Example 4

In the embodiment, an example of using polarity inversion driving in which in each of a left-eye frame and a right-eye frame, a time for applying a positive voltage to the liquid crystal element 120 is the same as that for applying a negative voltage has been described. However, a driving method in which in each of a left-eye frame and a right-eye frame, a time for applying a positive voltage to the liquid crystal element 120 is not the same as that for applying a negative voltage may be used. For example, a driving method in which the polarity of an applied voltage is inversed every frame may be used.

Modified Example 5

In the embodiment, an example in which the comparator 303 determines whether the gray-scale values of object pixels in a left-eye image and a right-eye image are the same has been described. "The same" used herein includes not only completely the same but also the case where a difference in gray-scale value of an object pixel between a left-eye image and a right-eye image is less than a predetermined threshold value.

Modified Example 6

In the embodiment, an example in which a plurality of sub-fields have the same time length has been described. However, the plurality of sub-fields may not have the same time length. That is, the time length of each of sub-fields in one frame may be weighted by a predetermined rule, so that they may be different from each other.

Other Modified Examples

The electronic apparatus according to the invention is not limited to a projector. The invention may be used for televisions, viewfinder-type/monitor direct-view-type video tape recorders, car navigation systems, pagers, electronic notebooks, calculators, word processors, workstations, videophones, POS terminals, digital still cameras, mobile phones, apparatuses equipped with a touch panel, and the like.

The configuration of the electro-optic device 2100 is not limited to that exemplified in FIG. 3. The electro-optic device 2100 may have any configuration as long as it can realize the functions of FIG. 2. For example, an electro-optic element used for the electro-optic device 2100 is not limited to the liquid crystal element 120. Instead of the liquid crystal element 120, other electro-optic elements such as an organic EL (Electro-Luminescence) element may be used.

The parameters (for example, the number of sub-fields, the frame rate, the number of pixels, and the like) and the polarity or level of signal described in the embodiment are illustrative only, and the invention is not limited to them.

The entire disclosure of Japanese Patent Application No. 2011-202250, filed Sep. 15, 2011 is expressly incorporated by reference herein.

What is claimed is:

1. An electro-optic device comprising:

a plurality of electro-optic elements each of which expresses a gray scale corresponding to a supplied signal;

a storage unit which stores a first table and a second table, the first table including a plurality of pairs of a gray-scale value and a sub-field code indicating a combination of ON and OFF for a sub-fields, the second table including a plurality of pairs of a gray-scale value and a sub-field code indicating a combination of ON and OFF for b (b>a) sub-fields;

an input unit which receives a video signal including a first image and a second image each expressed by the gray-scale values of a plurality of pixels, the video signal indicating a plurality of images divided into frames;

a converting unit which converts, for object pixels as objects in the plurality of pixels, the gray-scale value of the object pixel into the sub-field code using the second table when a difference in gray-scale value between the first image and the second image is less than a threshold value, while converting the gray-scale value of the object pixel into the sub-field code using the first table when the difference in gray-scale value between the first image and the second image is the threshold value or more; and a driving unit which supplies, in each of a plurality of sub-fields obtained by dividing a period for displaying an image of one frame, a signal corresponding to the sub-field code converted by the converting unit to drive the plurality of electro-optic elements.

2. The electro-optic device according to claim 1, wherein the first image is a right-eye image, the second image is a left-eye image, and the object pixels are pixels of the right-eye image and the left-eye image in a single frame.

3. The electro-optic device according to claim 2, wherein the driving unit performs polarity inversion driving in each of the right-eye image and the left-eye image in a single frame.

4. The electro-optic device according to claim 1, wherein the equation of b=2a is satisfied.

5. The electro-optic device according to claim 1, wherein the response time of the electro-optic element is a time corresponding to c (c<a) sub-fields, and the equation of b=2a+c is satisfied.

6. An electronic apparatus comprising the electro-optic device according to claim 1.

7. An electronic apparatus comprising the electro-optic device according to claim 2.

8. An electronic apparatus comprising the electro-optic device according to claim 3.

9. An electronic apparatus comprising the electro-optic device according to claim 4.

10. An electronic apparatus comprising the electro-optic device according to claim 5.

11. A method for driving an electro-optic device including a plurality of electro-optic elements each of which expresses a gray scale corresponding to a supplied signal, and a storage unit which stores a first table and a second table, the first table including a plurality of pairs of a gray-scale value and a sub-field code indicating a combination of ON and OFF for a sub-fields, the second table including a plurality of pairs of a gray-scale value and a sub-field code indicating a combination of ON and OFF for b (b>a) sub-fields, the driving method comprising:

receiving a video signal including a first image and a second image each expressed by the gray-scale values of a plurality of pixels, the video signal indicating a plurality of images divided into frames;

converting, for object pixels as objects in the plurality of pixels, the gray-scale value of the object pixel into the sub-field code using the second table when a difference in gray-scale value between the first image and the second image is less than a threshold value, while converting the gray-scale value of the object pixel into the sub-field code using the first table when the difference in gray-scale value between the first image and the second image is the threshold value or more; and supplying, in each of a plurality of sub-fields obtained by dividing a period for displaying an image of one frame, a signal corresponding to the converted sub-field code to drive the plurality of electro-optic elements.

* * * * *